US012220608B2

(12) United States Patent
Smith

(10) Patent No.: US 12,220,608 B2
(45) Date of Patent: Feb. 11, 2025

(54) DUMBBELL ATTACHMENT APPARATUS WITH TWO-HANDED GRIP CONFIGURATION

(71) Applicant: Erik Smith, San Francisco, CA (US)

(72) Inventor: Erik Smith, San Francisco, CA (US)

( * ) Notice: Subject to any disclaimer, the term of this patent is extended or adjusted under 35 U.S.C. 154(b) by 75 days.

(21) Appl. No.: 17/961,681

(22) Filed: Oct. 7, 2022

(65) Prior Publication Data

US 2024/0115900 A1 Apr. 11, 2024

(51) Int. Cl.
*A63B 21/072* (2006.01)
*A63B 21/00* (2006.01)

(52) U.S. Cl.
CPC ..... *A63B 21/0724* (2013.01); *A63B 21/0004* (2013.01); *A63B 21/0726* (2013.01)

(58) Field of Classification Search
CPC ..... A63B 21/0724; A63B 21/0004; A63B 21/0726; A63B 21/072; A63B 21/4035
See application file for complete search history.

(56) References Cited

U.S. PATENT DOCUMENTS 11,383,125 B2 * 7/2022 Martinez ..... A63B 21/0726
11,491,362 B2 * 11/2022 Anderson ..... A63B 21/075
11,752,385 B2 * 9/2023 Abbott ..... A63B 21/0722 482/106
2011/0177922 A1 * 7/2011 Selinger ..... A63B 21/0724 482/107
2011/0300999 A1 * 12/2011 Cavaliere ..... A63B 21/4049 482/108
2014/0024506 A1 * 1/2014 Vixathep ..... A63B 21/0726 482/108
2022/0062693 A1 * 3/2022 Martinez ..... A63B 21/4035
2023/0347197 A1 * 11/2023 Acri ..... A63B 21/072

* cited by examiner

*Primary Examiner* — Megan Anderson
*Assistant Examiner* — Andrew M Kobylarz
(74) *Attorney, Agent, or Firm* — The Rapacke Law Group, P.A.; Andrew S. Rapacke

(57) ABSTRACT

In some embodiments, systems or devices, such as removable attachments, bars, multi-bars, or handles, are disclosed that allow binding to a wide variety of dumbbells and barbells available on the market. Binding to dumbbells and barbells of various sizes, types, brands, shapes, weights, dimensions, diameters and/or handle diameters, etc., is advantageous to allow interoperability and adaptability. In some examples, the variety of exercises that can be performed with a single dumbbell or barbell may be expanded to include two-handed techniques with minimal additional equipment. In some examples, this can reduce costs of additional equipment, storage space needed to store additional equipment, etc.

12 Claims, 3 Drawing Sheets

DUMBBELL ATTACHMENT APPARATUS WITH TWO-HANDED GRIP CONFIGURATION

TECHNICAL FIELD

Embodiments herein relate to exercise or fitness equipment. In some examples, exercise or fitness equipment may include weightlifting devices such as dumbbells and barbells. In some embodiments, the present disclosure relates generally to attachments, devices, and/or apparatuses for use in weightlifting.

BACKGROUND

The benefits of exercise and physical activity are well-known. Exercise is important for physical health, longevity, and general well-being.

It follows that exercise and fitness equipment that can facilitate such activity can add value to the lives of many. In order to facilitate many forms of exercise and fitness activity, specialized equipment exists.

A wide range of exercise and fitness equipment options are available on the market today. However, with these increased choices has come interoperability and adaptability issues. Further, the problem of equipment storage grows when various equipment needs arise.

One form of exercise that often makes use of specialized equipment is strength training. For example, many devices exist for weightlifting. A large number of weightlifting devices such as dumbbells, barbells, and bars have been created. With them, some weightlifting bar handles were created.

However, previous weightlifting bar handles include sliding sleeves that are only compatible with weightlifting bars that use removable weight plates, not barbells or dumbbells, for example. These handles are inconvenient, require removal of weights, and are only usable for bars of a certain diameter.

In another example, previous weightlifting bar handles are formed having only one grip area thereby limiting a user to one-handed exercises.

In yet another example, previous weightlifting bar handles often modify or require an inconvenient center of gravity and/or weight distribution. Causing an inappropriate weight distribution and/or inappropriate center of gravity may destroy the intended efficacy of an exercise or even cause injury to a lifter.

Therefore, a need exists to provide a weightlifting bar attachment that can be more easily releasably attached to barbell or dumbbell bars having various diameters and/or that provide an appropriate center of gravity and/or weight distribution for weightlifting.

SUMMARY OF THE INVENTION

This summary is provided to introduce a variety of concepts in a simplified form that is disclosed further in the detailed description of the embodiments. This summary is not intended to identify key or essential inventive concepts of the claimed subject matter, nor is it intended for determining the scope of the claimed subject matter.

The embodiments provided herein relate to exercise or fitness equipment. In some examples, exercise or fitness equipment may include weightlifting devices such as dumbbells and barbells. In some embodiments, the present disclosure relates generally to attachments, devices, and/or apparatuses for use in weightlifting.

In some embodiments, systems, devices, and/or apparatuses such as removable attachments, bars, multi-bars, or handles, are disclosed that allow binding to a wide variety of dumbbells and barbells available on the market. Binding to dumbbells and barbells of various sizes, types, brands, shapes, weights, dimensions, diameters and/or handle diameters, etc., is advantageous to allow interoperability and adaptability. In some examples, the variety of exercises that can be performed with a single dumbbell or barbell may be expanded to include two-handed techniques with minimal additional equipment. In some examples, this can reduce costs of additional equipment, storage space needed to store additional equipment, etc.

In some embodiments, removable multi-bar dumbbell attachments are disclosed. In some embodiments, a multi-bar frame, device, and/or attachment comprising one or more bars and/or sets of grip areas is disclosed. In some embodiments, a multi-bar frame, device, and/or attachment comprising two sets of bars comprising grip areas is disclosed, wherein one set of bars is narrow, and one set of bars is wide.

In some embodiments, removable multi-bar dumbbell attachments are disclosed comprising a centered U-channel and clamp lid attached via a hinge and/or pivot point. In one example, a rivet or rivet-like may attach a clamp lid to a housing.

In some embodiments, a U-channel allowing for centered positioning of a dumbbell or barbell is provided. Such embodiments may attach and hold a dumbbell or barbell wherein a center of gravity and/or weight distribution of a dumbbell or barbell may be centered and/or at a midpoint of an axis defined by a lifter's hands when gripping bars on either side.

In some embodiments, a U-channel comprises a notch-and-tooth mechanism on an upper and lower end. In some embodiments, one or both of a U-channel and clamp lid are padded. In some embodiments, use of clamps and notch-and-tooth mechanisms in lieu of screw mechanisms are advantageous in that they are quick and easy to attach to a dumbbell or barbell. For example, such mechanisms do not require a greater force or work to attach, such as the force or work required to attach screw or pull-pin mechanisms.

In some embodiments, a safety strap may be included. In some examples, a nylon and Velcro safety strap may be included that may wrap around a center binding mechanism.

BRIEF DESCRIPTION OF THE DRAWINGS

A complete understanding of the present embodiments and the advantages and features thereof will be more readily understood by reference to the following detailed description when considered in conjunction with the accompanying drawings wherein.

DETAILED DESCRIPTION

Figure 1:
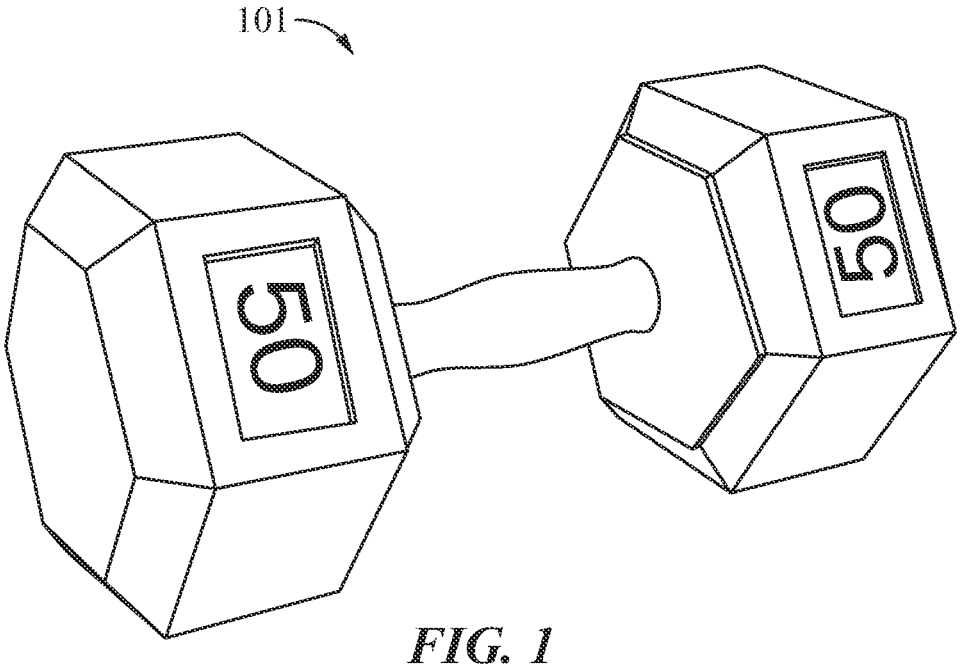
FIG. 1 (Prior Art)
FIG. 1 is a prior art view of example dumbbell equipment.

The specific details of the single embodiment or variety of embodiments described herein are set for in this application. Any specific details of the embodiments are used for demonstration purposes only, and no unnecessary limitation or inferences are to be understood therefrom.

Before describing in detail exemplary embodiments, it is noted that the embodiments reside primarily in combinations of components related to the system. Accordingly, the device components have been represented where appropriate by convention symbols in the drawings, showing only those specific details that are pertinent to understanding the embodiments of the present disclosure so as not to obscure the disclosure with details that will be readily apparent to those of ordinary skill in the art having the benefit of the description herein.

In this disclosure, the various embodiments may be a system, method, and/or computer program product at any possible technical detail level of integration. A computer program product can include, among other things, a computer-readable storage medium having computer-readable program instructions thereon for causing a processor to carry out aspects of the present disclosure.

Exercise and Fitness Equipment

In general, the embodiments described herein relate to exercise or fitness equipment. In some examples, exercise or fitness equipment may include weightlifting devices such as dumbbells and barbells. In some embodiments, the present disclosure relates generally to attachments, devices, and/or apparatuses for use in weightlifting.

Embodiments herein may be compatible with some or all aspects or parts of disclosures such as in "Weightlifting Bar Handle," US 2022/0062693 A1, which is incorporated by reference in entirety herein.

However, this prior art disclosure fails, for example, to provide/maintain a center of gravity and/or weight distribution wherein the center of gravity of the weight being lifted is between the lifter's hands (between the grips) such as at a center or midpoint on an axis defined by the lifter's hands. Instead, the center of gravity is removed/displaced from the center of this example axis. Further, this prior art disclosures requires set screws and the like, which is further inconvenient, cumbersome, and even dangerous.

Embodiments herein may be compatible with some or all aspects or parts of disclosures such as in "An apparatus for reducing body stress on an exerciser," US 2006/0105890 A1, which is incorporated by reference in entirety herein. For example, examples of a "W" configuration bar are described and compatible with embodiments described herein.

Embodiments herein may be compatible with some or all aspects or parts of disclosures such as in "multi-grip exercise bar," U.S. Pat. No. 9,254,410 B1, which is incorporated by reference in entirety herein. For example, examples of a curl bar are described and compatible with embodiments described herein.

In some embodiments, systems or devices, such as removable attachments, bars, multi-bars, multi-grip bars, or handles, are disclosed that allow binding to a wide variety of dumbbells, barbells, and exercise equipment available on the market. Binding to dumbbells and barbells of various sizes, types, brands, shapes, weights, dimensions, diameters and/or handle diameters, etc., is advantageous to allow interoperability and adaptability. In some examples, embodiments herein may bind to exercise equipment handles and/or grip areas within a range of diameters. For example, a range of diameters may be between 0.5 inches and 4 inches. In another example, a range of diameters may be between 1 inch and 3 inches. In another example, a range of diameters may be between 2 inches and 3 inches. In some examples, the variety of exercises that can be performed with a single dumbbell or barbell may be expanded to include two-handed techniques with minimal additional equipment. In some examples, this can reduce costs of additional equipment, storage space needed to store additional equipment, etc.

In some embodiments, removable multi-bar dumbbell attachments are disclosed. In some embodiments, a multi-bar frame comprising one or more sets of grips is disclosed. In some embodiments, a multi-bar frame comprising two sets of grips is disclosed, wherein one set is narrow, and one set is wide. In some embodiments, one or more bars of a multi-bar attachment may be attached to a dumbbell or barbell perpendicularly, or substantially perpendicularly, to one or more bars or grips of the dumbbell or barbell received or positioned within the attachments. In some embodiments, one or more bars of a multi-bar attachment may be attached to a dumbbell or barbell parallelly, or substantially parallelly, to one or more bars or grips of the dumbbell or barbell received or positioned within the attachments. In some embodiments, one or more bars of a multi-bar attachment may be attached to a dumbbell or barbell in a combination of the aforementioned.

In some embodiments, removable multi-bar dumbbell attachments are disclosed comprising a centered U-channel and clamp lid attached via a hinge. In some embodiments, a U-channel comprises a notch and tooth mechanism on an upper and lower end. In some embodiments, one or both of a U-channel and clamp lid are padded.

In some embodiments, a safety strap may be included. In some examples, a nylon and Velcro safety strap may be included that may wrap around a center binding mechanism.

FIG. 1 is a prior art view of example dumbbell equipment with which embodiments herein may be compatible, for example.

The example dumbbell shows a weight with a grip suitable for one-handed exercises, but which is not ideal and/or suitable for two-handed exercises.

Embodiments herein may be used as attachments for a dumbbell 101 such as the one shown in FIG. 1. Embodiments herein therefore may effectively transform exercise equipment only suitable for one-handed exercises into exercise equipment suitable for two-handed exercises.

Figure 2:
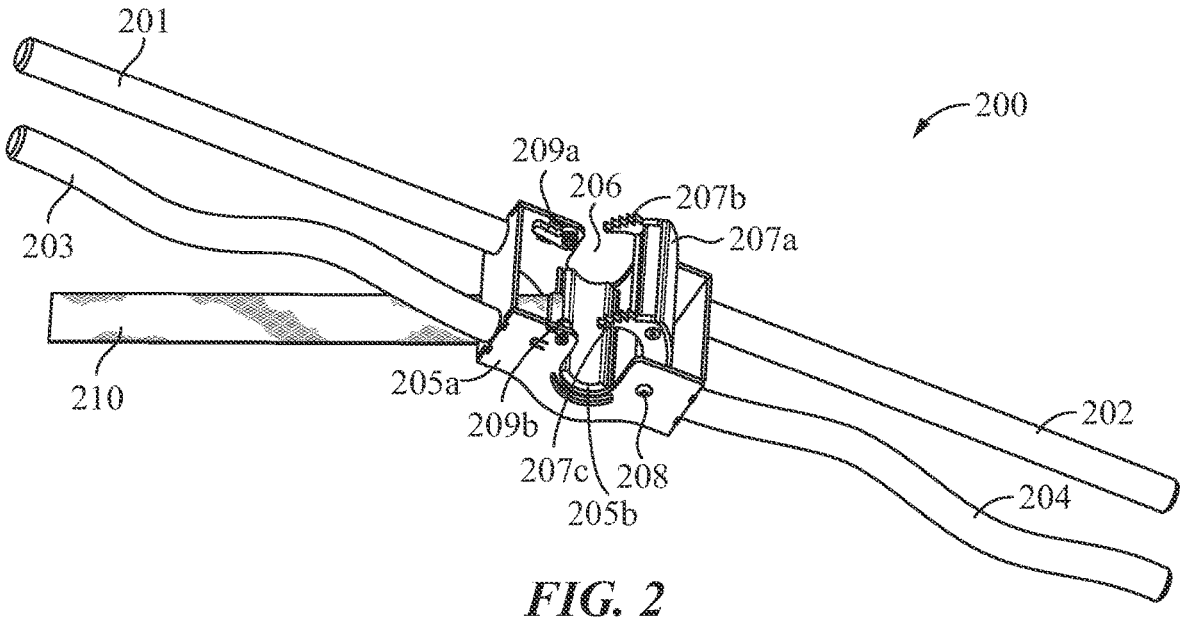
FIG. 2 shows a schematic view of an exercise equipment attachment with a clamp mechanism in an open position according to some embodiments.

FIG. 2 shows a schematic view of an exercise equipment attachment 200 with a clamp mechanism in a closed position according to some embodiments.

Exercise equipment attachment 200 may be a dumbbell or barbell attachment device, for example, that enables transformation of a one-handed exercise equipment to two-handed exercise equipment or utilization of a one-handed exercise equipment to two-handed exercise equipment.

Exercise equipment attachment 200 may comprise a first bar, grip, and/or handle. A first bar 201 is shown in 200. In some examples, first bar, grip, and/or handle may be comprised of cast iron, steel, aluminum, brass, ceramic, carbon fiber, plastic, or other metals. First bar, grip, and/or handle may comprise one or more grip areas and/or sections.

Exercise equipment attachment 200 may comprise a second bar, grip, and/or handle. A second bar 202 is shown in 200. In some examples, second bar, grip, and/or handle may be comprised of cast iron, steel, aluminum, brass, ceramic, carbon fiber, plastic, or other metals. Second bar, grip, and/or handle may comprise one or more grip areas and/or sections.

Exercise equipment attachment 200 may comprise a third bar, grip, and/or handle. A third bar 203 is shown in 200. In some examples, third bar, grip, and/or handle may be comprised of cast iron, steel, aluminum, brass, ceramic, carbon fiber, plastic, or other metals. Third bar, grip, and/or handle may comprise one or more grip areas and/or sections.

Exercise equipment attachment 200 may comprise a fourth bar, grip, and/or handle. A fourth bar 204 is shown in 200. In some examples, fourth bar, grip, and/or handle may be comprised of cast iron, steel, aluminum, brass, ceramic, carbon fiber, plastic, or other metals. Fourth bar, grip, and/or handle may comprise one or more grip areas and/or sections.

Exercise equipment attachment 200 may further comprise a housing 205*a-b* (together, "205") that may be centralized. In some embodiments, central housing 205 may comprise an assembly portion 205*a* and a support member 205*b*.

In some embodiments one or more of first bar 201, second bar 202, third bar 203, and fourth bar 204 may be attached to central housing 205. For example, one or more of first bar 201, second bar 202, third bar 203, and fourth bar 204 may be welded, or riveted, to central housing 205. In some examples, central housing 205 may be comprised of cast iron, steel, aluminum, brass, ceramic, carbon fiber, plastic, or other metals.

In some embodiments, one or more of first bar 201, second bar 202, third bar 203, fourth bar 204, and central housing 205 may be comprised of a same product from a list comprising cast iron, steel, aluminum, brass, ceramic, carbon fiber, plastic, or other metals.

In some embodiments, first bar 201 and second bar 202 are of equal size and equal shape.

In some embodiments, first bar 201 and second bar 202 are of different size and different shape.

In some embodiments, first bar 201 and second bar 202 are cylindrical and/or tubular. In some embodiments, first bar 201 and second bar 202 are arranged in a parallel, or substantially parallel, configuration to each other.

In some embodiments, first bar 201 and second bar 202 are hallow allowing for a more lightweight device. In some embodiments, first bar 201 and second bar 202 are solid allowing for a stronger device. In some embodiments, each of first bar 201 and second bar 202 comprise one or more grip areas that are knurled. In some embodiments, each of first bar 201 and second bar 202 comprise two grip areas that are knurled.

In some embodiments, third bar 203 and fourth bar 204 are of equal size and equal shape. In some embodiments, third bar 203 and fourth bar 204 are of different size and different shape. In some embodiments, third bar 203 and fourth bar 204 are cylindrical and/or tubular. In some embodiments, third bar 203 and fourth bar 204 are arranged in a parallel, or substantially parallel, configuration to each other.

In some embodiments, third bar 203 and fourth bar 204 are hallow allowing for a more lightweight device. In some embodiments, third bar 203 and fourth bar 204 are solid allowing for a stronger device. In some embodiments, each of third bar 203 and fourth bar 204 comprise one or more grip areas that are knurled. In some embodiments, each of third bar 203 and fourth bar 204 comprise two grip areas that are knurled.

In some embodiments, one or more of each of first bar 201, second bar 202, third bar 203, and fourth bar 204 may be in a wavy and/or "W" configuration and/or shape.

In some embodiments, one or more of each of first bar 201, second bar 202, third bar 203, and fourth bar 204 may be in a curl bar configuration and/or shape.

In some embodiments, one or more bars may be symmetrically installed and/or attached to a housing or central housing. In one example, first bar 201 may be installed and/or attached to central housing 205 symmetrically to second bar 202. In another example, third bar 203 may be installed and/or attached to central housing 205 symmetrically to fourth bar 204.

In some embodiments, central housing 205 may comprise or form a centered U-channel 206 and/or clamp lid 207 attached via a hinge 208. Hinge 208 may comprise a screw, rivet, or similar pivotable attachment mechanism. In some embodiments, clamp lid 207*a* over U-channel 206 comprises one or more notch and tooth mechanisms on upper 207*b*, lower 207*c*, and/or side ends. In some embodiments, one or both of U-channel 206 and/or clamp lid 207*a* sides and/or edges are padded.

In some embodiments, central housing 205 may comprise an assembly portion 205*a* such as a rectangular or square-shaped structure comprising a U-shaped channel ("U-channel") 206 allowing intake of a dumbbell or barbell. In some embodiments, central housing 205 may comprise a support member 205*b* such as at a base of a U-shaped channel ("U-channel") allowing support of a dumbbell or barbell.

In some embodiments, exercise equipment attachment 200 may be a multi-modal dumbbell or barbell attachment device, allowing for attachment, connection, and/or positioning of dumbbells or barbells of various sizes and/or handle/grip diameters.

In some embodiments, U-channel 206 may be a multi-modal dumbbell or barbell receiving device, area, and/or section, allowing for attachment, connection, and/or positioning of dumbbells or barbells of various sizes and/or handle/grip diameters. Clamp lid 207*a* may be used to enclose and fit appropriately a dumbbell or barbell positioned and supported by support member 205*b* within U-channel 206. In some embodiments, a dumbbell or barbell in is positioned, enclosed, attached, and/or fixed wherein the center of gravity and/or weight distribution is positioned within the center of central housing 205 and/or within U-channel 206.

In some embodiments, U-channel 206 is positioned within central housing 205 to allow for receiving and/or positioning a dumbbell or barbell handle. In some embodiments, U-channel 206 allows for positioning a center of gravity and/or weight distribution of a dumbbell or barbell between a lifter's hands and/or at a midpoint of an axis defined by the lifter's two hands.

For example, a lifter may use attachment to lift, using two/both hands, a dumbbell or barbell positioned within U-channel 206 using first bar 201 and second bar 202. In this example, when the lifter lifts the dumbbell or barbell, the center of gravity and/or weight distribution of the dumbbell or barbell will be between his hands and/or at the midpoint of an axis defined by his two hands when gripping first bar 201 and second bar 202.

In another example, a lifter may use attachment to lift, using two/both hands, a dumbbell or barbell positioned within U-channel 206 using third bar 203 and fourth bar 204. In this example, when the lifter lifts the dumbbell or barbell, the center of gravity and/or weight distribution of the dumbbell or barbell will be between his hands and/or at the midpoint of an axis defined by his two hands when gripping third bar 203 and fourth bar 204.

In some embodiments, one or more of each notch and tooth mechanism may engage one or more releasable locking mechanisms 209*a* and 209*b*. One or more of each releasable locking mechanisms 209*a* and 209*b* may comprise, for example, a spring-loaded and/or rotatable about a screw attachment to central housing 205 lever, clip, handle, and/or switch. Releasable locking mechanisms 209*a* and 209*b* may, for example, engage with notch and tooth mechanisms on upper 207*b*, lower 207*c*, respectively, to clamp lid 207*a* in a closed position around, for example, a handle and/or grip of a dumbbell or barbell.

In some embodiments, central housing 205 may further comprise one or more safety mechanisms, such as a safety strap 210. Safety strap 210 may comprise a nylon and/or Velcro safety strap that can wrap around the center binding mechanism and/or clamp lid 207*a* when in a closed position, for example.

In one example embodiment, exercise equipment attachment 200 comprises a removable multi-bar dumbbell or barbell attachment. In this example, first bar 201, second bar 202, third bar 203, and fourth bar 204, each comprising one or more sets of grip areas and/or sections, are attached to central housing 205. In some embodiments, grip areas and/or sections may be partially or fully knurled.

Further, in this example, first bar 201 and second bar 202 are straight, tubular bars arranged in a parallel configuration to each other.

Further, in this example, third bar 203 and fourth bar 204 are curl bar shapes/configured, tubular bars arranged in a parallel configuration to each other.

Figure 3:
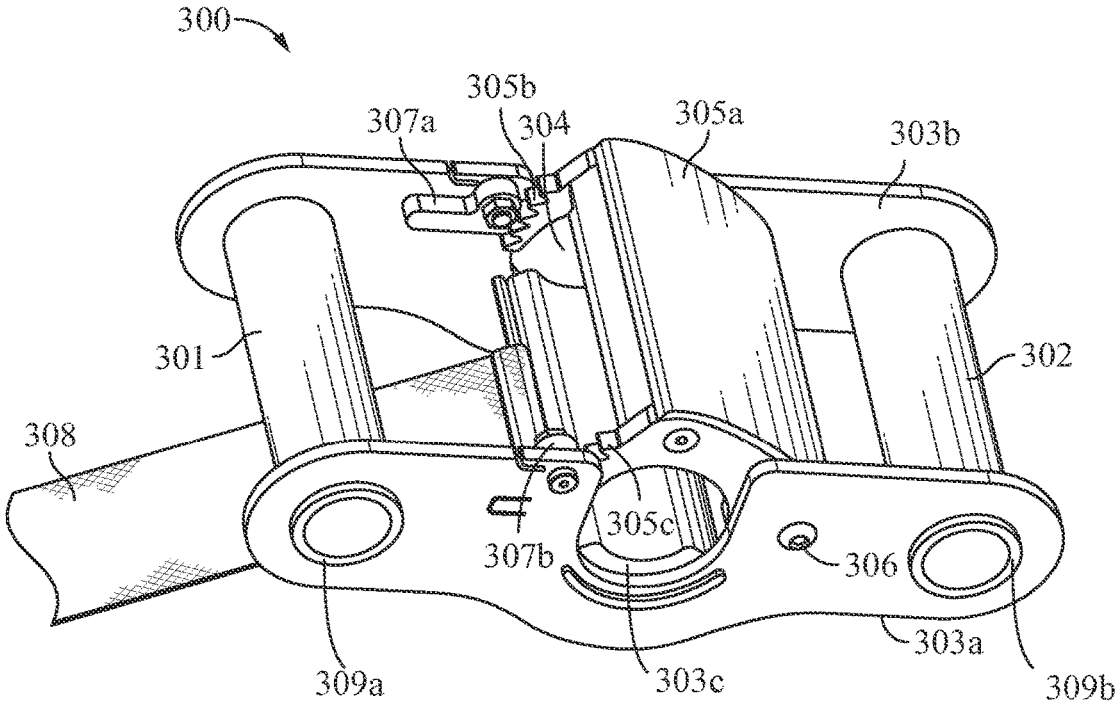
FIG. 3 shows another schematic view of an exercise equipment attachment with a clamp mechanism in a closed position according to some embodiments.

FIG. 3 shows another schematic view 300 of an exercise equipment attachment with a clamp mechanism in a closed position according to some embodiments.

Exercise equipment attachment 300 may be a dumbbell or barbell attachment device, for example, that enables transformation of a one-handed exercise equipment to two-handed exercise equipment or utilization of a one-handed exercise equipment to two-handed exercise equipment.

In some embodiments, exercise equipment attachment 300 may be a multi-modal dumbbell or barbell attachment device, allowing for attachment, connection, and/or positioning of dumbbells or barbells of various sizes and/or handle/grip diameters.

Exercise equipment attachment 300 may comprise a first bar, grip, and/or handle. A first bar 301 is shown in 300. In some examples, first bar, grip, and/or handle may be comprised of cast iron, steel, aluminum, brass, ceramic, carbon fiber, plastic, or other metals. First bar, grip, and/or handle may comprise one or more grip areas and/or sections.

Exercise equipment attachment 300 may comprise a second bar, grip, and/or handle. A second bar 302 is shown in 300. In some examples, second bar, grip, and/or handle may be comprised of cast iron, steel, aluminum, brass, ceramic, carbon fiber, plastic, or other metals. Second bar, grip, and/or handle may comprise one or more grip areas and/or sections.

Exercise equipment attachment 300 may further comprise a housing 303 (comprising 303*a*-303*c*) that may be centralized. Housing 303 may comprise a first end plate 303*a*, a second end plate 303*b*, and/or a support member 303*c*, for example. Support member 303*c* may comprise a curved plate, for example.

In some embodiments one or more of first bar 301 and bar 302 may be attached to central housing 303. In some examples, central housing 303 may be comprised of cast iron, steel, aluminum, brass, ceramic, carbon fiber, plastic, or other metals.

In some embodiments, one or more of first bar 301, second bar 302, and central housing 303 may be comprised of a same product from a list comprising cast iron, steel, aluminum, brass, ceramic, carbon fiber, plastic, or other metals.

In some embodiments, first bar 301 and second bar 302 are of equal size and equal shape. In some embodiments, first bar 301 and second bar 302 are of different size and different shape.

In some embodiments, first bar 301 and second bar 302 are of equal distance from the center of the exercise equipment attachment 300. In some embodiments, first bar 301 and second bar 302 are of different distance from the center of the exercise equipment attachment 300.

In some embodiments, first bar 301 and second bar 302 are cylindrical and/or tubular. In some embodiments, first bar 301 and second bar 302 are arranged in a parallel, or substantially parallel, configuration to each other.

In some embodiments, first bar 301 and second bar 302 are hallow allowing for a more lightweight device. In some embodiments, first bar 301 and second bar 302 are solid allowing for a stronger device. In some embodiments, each of first bar 301 and second bar 302 comprise one or more grip areas that are knurled. In some embodiments, each of first bar 301 and second bar 302 comprise two grip areas that are knurled.

In some embodiments, one or more of first bar 301 and second bar 302 may be in a wavy and/or "W" configuration and/or shape.

In some embodiments, one or more of first bar 301 and second bar 302 may be in a curl bar configuration and/or shape.

In some embodiments, one or more bars may be symmetrically installed and/or attached to a housing or central housing. In one example, first bar 301 may be installed and/or attached to central housing 303 symmetrically to second bar 302.

In some embodiments, central housing 303 may comprise or form a centered U-channel 304 and/or clamp lid 305*a* attached via a hinge 306. Hinge 306 may comprise a screw, rivet, or similar pivotable attachment mechanism. In some embodiments, clamp lid 305*a* over U-channel 304 comprises one or more notch and tooth mechanisms on upper 305*b*, lower 305*c*, and/or side ends. In some embodiments, one or both of U-channel 304 and/or clamp lid 305*a* sides and/or edges are padded.

In some embodiments, central housing 303 may comprise one or more end plates 303*a*-303*b* each shaped or having or cutouts comprising or forming a U-shaped channel ("U-channel") 304 allowing intake of a dumbbell or barbell. In some embodiments, central housing 303 may comprise a support member 303*c* such as at a base of a U-shaped channel ("U-channel") allowing support of a dumbbell or barbell.

In some embodiments, exercise equipment attachment 300 may be a multi-modal dumbbell or barbell attachment device, allowing for attachment, connection, and/or positioning of dumbbells or barbells of various sizes and/or handle/grip diameters.

In some embodiments, U-channel 304 may be a multi-modal dumbbell or barbell receiving device, area, and/or section, allowing for attachment, connection, and/or positioning of dumbbells or barbells of various sizes and/or handle/grip diameters. Clamp lid 305*a* may be used to enclose and fit appropriately a dumbbell or barbell positioned and supported by support member 303*c* within U-channel 304. In some embodiments, a dumbbell or barbell in is positioned, enclosed, attached, and/or fixed wherein the center of gravity and/or weight distribution is positioned within the center of central housing 303 and/or within U-channel 304.

In some embodiments, U-channel 304 is positioned within central housing 303 to allow for receiving and/or positioning a dumbbell or barbell handle. In some embodiments, U-channel 304 allows for positioning a center of gravity and/or weight distribution of a dumbbell or barbell between a lifter's hands and/or at a midpoint of an axis defined by the lifter's two hands.

For example, a lifter may use attachment to lift, using two/both hands, a dumbbell or barbell positioned within U-channel 304 using first bar 301 and second bar 302. In this example, when the lifter lifts the dumbbell or barbell, the center of gravity and/or weight distribution of the dumbbell or barbell will be between his hands and/or at the midpoint of an axis defined by his two hands when gripping first bar 301 and second bar 302.

In some embodiments, one or more of each notch and tooth mechanism may engage one or more releasable locking mechanisms 306*a* and 306*b*. One or more of each releasable locking mechanisms 306*a* and 306*b* may comprise, for example, a spring-loaded and/or rotatable about a screw attachment to central housing 307 lever, clip, handle, and/or switch. Releasable locking mechanisms 306*a* and 306*b* may, for example, engage with notch and tooth mechanisms on upper 305*b*, lower 305*c*, respectively, to clamp lid 305*a* in a closed position around, for example, a handle and/or grip of a dumbbell or barbell.

In some embodiments, housing and/or central housing 303 may comprise one or more end plates 303*a*-303*b*. In some embodiments, end plates 303*a*-303*b* may be rectangular and/or comprise rounded sides and/or ends. Rounded sides may allow for safety advantages in some cases.

In some embodiments, one or more bars may be installed and/or attached to housing or central housing wherein the one or more bars are installed symmetrically to each other. In one example, first bar 301 may be installed and/or attached to central housing end plates 303*a*-303*b* symmetrically to second bar 302.

In some embodiments, each of end plates 303*a*-303*b* may comprise a shape and/or cutout comprising a U-shaped channel ("U-channel") allowing intake of a dumbbell or barbell (such as a dumbbell handle).

Rounded end plates may be attached to, or by, one or more bars. For example, as shown in 300, first bar 301 and second bar 302 may each be attached to each end plate, creating a contiguous and/or reinforced structure.

In some embodiments, end plates may comprise holes through which one or more bars are fitted. In some examples, bars may be set within holes and protrude from holes by, for example, between 0.15 inches and 0.5 inches on each side of end plate attachment. Each protrusion may allow for welding, riveting and/or fixing bars within their respective holes to provide a structurally sound device, such as by a welding technique, riveting technique, or riveting-like technique, described below.

In one example, end plates 303*a*-303*b* may comprise holes or openings through which first bar 301 and second bar 302 are fitted. For example, first bar 301 may be fitted through first hole 309*a*. And, for example, second bar 302 may be fitted through second hole 309*b*.

Riveting and/or Riveting Like Techniques

In some embodiments, a riveting-like technique may be used to attach one or more bars to central housing.

A rivet may be considered a permanent mechanical fastener in some cases. For example, a rivet may comprise of a smooth cylindrical shaft with a head on one end, similar in shape to a screw. The end opposite to the head may be called the tail.

During installation, a rivet may be placed in a punched or drilled hole, and the tail may be upset, or bucked (i.e., deformed), so that it expands to about, for example, 1.5 times the original shaft diameter, holding the rivet in place.

That is, pounding or pulling creates a new "head" on the tail end by upsetting and or deforming the "tail" material flatter, resulting in a rivet that is roughly a dumbbell shape. An original rivet head may be referred to as the factory head and the deformed end may be referred to as the shop head or buck-tail.

By effectively creating a head on each end of an installed rivet, such an installation can support tension loads. However, such an installation is even more capable of supporting shear loads (loads perpendicular to the axis of the shaft).

In some embodiments, a riveting and/or riveting like technique is used to produce an attachment that can advantageously withstand powerful shear loads associated with weightlifting.

For purposes herein, bars installed using a riveting-like technique as just described may be referred to as, for example, "riveted", "riveted bars", and/or "riveted handles." Further, purposes herein, bars or handles installed using a riveting-like technique through one or more end plates may be described as bars or handles that are "riveted to", "riveted through", or "riveted within" the one or more end plates, for example.

In one example, first bar 301 may be comprised of a factory head and tail used as a shop head, as described. First bar 301 may be passed through a hole 309*a* and fixed or installed to end plate 303*a* using a riveting and/or riveting-like technique. Alternatively, and/or in combination, a welding technique may be used to fix and/or install first bar 301 within or to end plate 303*a*.

In another example, second bar 302 may be comprised of a factory head and tail used as a shop head, as described. Second bar 302 may be passed through a hole 309*b* and fixed or installed to end plate 303*a* using a riveting and/or riveting-like technique. Alternatively, and/or in combination, a welding technique may be used to fix and/or install second bar 302 within or to end plate 303*a*.

It will be understood that first bar 301 and second bar 302, for example, may be similarly fixed and/or attached to second end plate 303*b*.

Similarly, support or support member 303*c* may be riveted through one or more end plates such as end plate 303*a*.

In some embodiments, central housing 303 may further comprise one or more safety mechanisms, such as a safety strap 308. Safety strap 308 may comprise a nylon and/or Velcro safety strap that can wrap around the center binding mechanism and/or clamp lid 305*a* when in a closed position, as shown in 300, for example.

Figure 4:
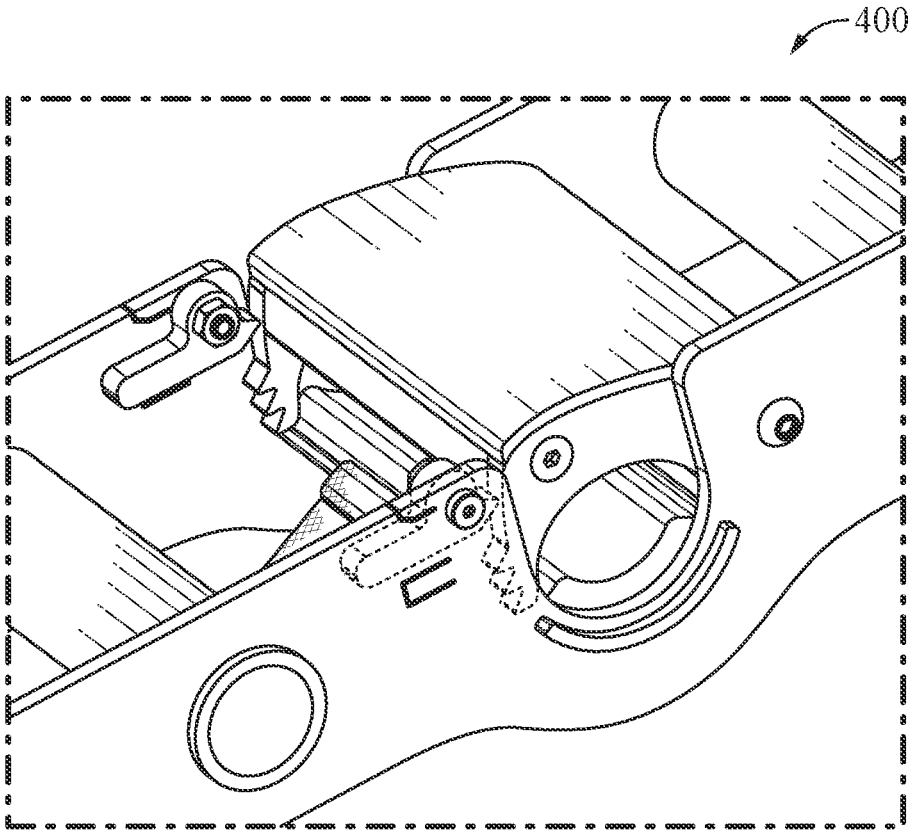
FIG. 4 shows another schematic view of an exercise equipment attachment with a clamp mechanism in a closed position according to some embodiments.

FIG. 4 shows another schematic view 400 of an exercise equipment attachment with a clamp mechanism in a closed position according to some embodiments.

Figure 5:
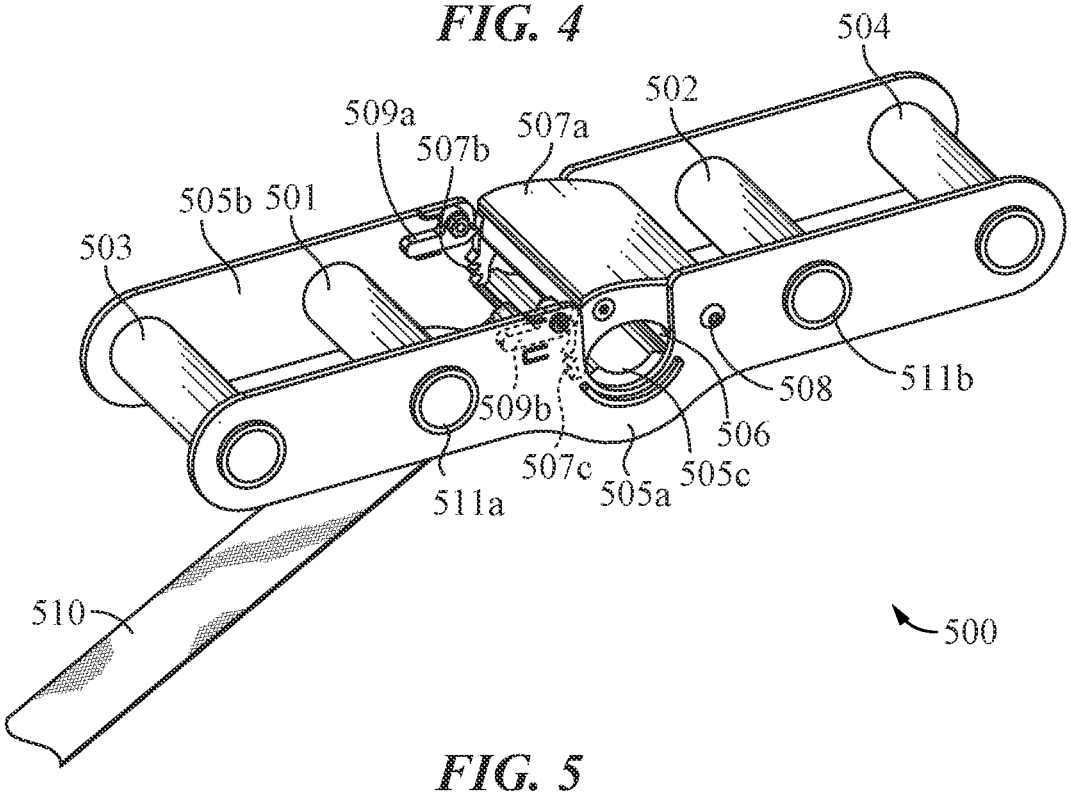
FIG. 5 shows another schematic view of an exercise equipment attachment with a clamp mechanism in a closed position according to some embodiments.

FIG. 5 shows a schematic view of an exercise equipment attachment 500 with a clamp mechanism in a closed position according to some embodiments.

Exercise equipment attachment 500 may be a dumbbell or barbell attachment device, for example, that enables transformation of a one-handed exercise equipment to two-handed exercise equipment or utilization of a one-handed exercise equipment to two-handed exercise equipment.

In some embodiments, exercise equipment attachment 500 may be a multi-modal dumbbell or barbell attachment device, allowing for attachment, connection, and/or positioning of dumbbells or barbells of various sizes and/or handle/grip diameters.

Exercise equipment attachment 500 may comprise a first bar, grip, and/or handle. A first bar 501 is shown in 500. In some examples, first bar, grip, and/or handle may be comprised of cast iron, steel, aluminum, brass, ceramic, carbon fiber, plastic, or other metals. First bar, grip, and/or handle may comprise one or more grip areas and/or sections.

Exercise equipment attachment 500 may comprise a second bar, grip, and/or handle. A second bar 502 is shown in 500. In some examples, second bar, grip, and/or handle may be comprised of cast iron, steel, aluminum, brass, ceramic, carbon fiber, plastic, or other metals. Second bar, grip, and/or handle may comprise one or more grip areas and/or sections.

Exercise equipment attachment 500 may comprise a third bar, grip, and/or handle. A second bar 503 is shown in 500. In some examples, third bar, grip, and/or handle may be comprised of cast iron, steel, aluminum, brass, ceramic, carbon fiber, plastic, or other metals. Third bar, grip, and/or handle may comprise one or more grip areas and/or sections.

Exercise equipment attachment 500 may comprise a fourth bar, grip, and/or handle. A fourth bar 504 is shown in 500. In some examples, fourth bar, grip, and/or handle may be comprised of cast iron, steel, aluminum, brass, ceramic, carbon fiber, plastic, or other metals. Fourth bar, grip, and/or handle may comprise one or more grip areas and/or sections.

Exercise equipment attachment 500 may further comprise a housing 505*a-c* (together, "505") that may be centralized. Housing 505 may comprise a first end plate 505*a*, a second end plate 505*b*, and/or a support member 505*c*, for example.

In some embodiments one or more of first bar 501 and second bar 502 may be attached to central housing 505. In some examples, central housing 505 may be comprised of cast iron, steel, aluminum, brass, ceramic, carbon fiber, plastic, or other metals.

In some embodiments, one or more of first bar 501, second bar 502, third bar 503, fourth bar 504, and central housing 505 may be comprised of a same product from a list comprising cast iron, steel, aluminum, brass, ceramic, carbon fiber, plastic, or other metals.

In some embodiments, first bar 501 and second bar 502 are of equal size and equal shape. In some embodiments, first bar 501 and second bar 502 are of different size and different shape.

In some embodiments, first bar 501 and second bar 502 are of equal distance from the center of the attachment 500. In some embodiments, first bar 501 and second bar 502 are of different distance from the center of the attachment 500.

In some embodiments, first bar 501 and second bar 502 are cylindrical and/or tubular. In some embodiments, first bar 501 and second bar 502 are arranged in a parallel, or substantially parallel, configuration to each other.

In some embodiments, third bar 503 and fourth bar 504 are of equal size and equal shape. In some embodiments, third bar 503 and fourth bar 504 are of different size and different shape.

In some embodiments, third bar 503 and fourth bar 504 are of equal distance from the center of the attachment 500. In some embodiments, third bar 503 and fourth bar 504 are of different distance from the center of the attachment 500.

In some embodiments, third bar 503 and fourth bar 504 are cylindrical and/or tubular. In some embodiments, third bar 503 and fourth bar 504 are arranged in a parallel, or substantially parallel, configuration to each other.

In some embodiments, one or more of first bar 501, second bar 502, third bar 503, and fourth bar 504 are hallow allowing for a more lightweight device. In some embodiments, one or more of first bar 501, second bar 502, third bar 503, and fourth bar 504 are solid allowing for a stronger device. In some embodiments, one or more of first bar 501, second bar 502, third bar 503, and fourth bar 504 comprise one or more grip areas that are knurled. In some embodiments, one or more of first bar 501, second bar 502, third bar 503, and fourth bar 504 comprise two grip areas that are knurled.

In some embodiments, one or more of first bar 501, second bar 502, third bar 503, and fourth bar 504 may be in a wavy and/or "W" configuration and/or shape.

In some embodiments, one or more of first bar 501, second bar 502, third bar 503, and fourth bar 504 may be in a curl bar configuration and/or shape.

In some embodiments, one or more bars may be symmetrically installed and/or attached to a housing or central housing. In one example, first bar 501 may be installed and/or attached to central housing 505 symmetrically to second bar 502. In another example, third bar 501 may be installed and/or attached to central housing 505 symmetrically to fourth bar 504.

In some embodiments, central housing 505 may comprise or form a centered U-channel 506 and/or clamp lid 507*a* attached via a hinge 508. Hinge 508 may comprise a screw, rivet, or similar pivotable attachment mechanism. In some embodiments, clamp lid 507*a* over U-channel 506 comprises one or more notch and tooth mechanisms on upper 507*b*, lower 507*c*, and/or side ends. In some embodiments, one or both of U-channel 506 and/or clamp lid 507*a* sides and/or edges are padded.

In some embodiments, central housing 505 may comprise one or more end plates 505*a*-505*b* each shaped or having cutouts comprising or forming a U-shaped channel ("U-channel") 506 allowing intake of a dumbbell or barbell. In some embodiments, central housing 505 may comprise a support member 505*c* such as at a base of a U-shaped channel ("U-channel") allowing support of a dumbbell or barbell.

In some embodiments, exercise equipment attachment 500 may be a multi-modal dumbbell or barbell attachment device, allowing for attachment, connection, and/or positioning of dumbbells or barbells of various sizes and/or handle/grip diameters.

In some embodiments, U-channel 506 may be a multi-modal dumbbell or barbell receiving device, area, and/or section, allowing for attachment, connection, and/or positioning of dumbbells or barbells of various sizes and/or handle/grip diameters. Clamp lid 507*a* may be used to enclose and fit appropriately a dumbbell or barbell positioned and supported by support member 505*c* within U-channel 506. In some embodiments, a dumbbell or barbell in is positioned, enclosed, attached, and/or fixed wherein the center of gravity and/or weight distribution is positioned within the center of central housing 505 and/or within U-channel 506.

In some embodiments, U-channel 506 is positioned within central housing 505 to allow for receiving and/or positioning a dumbbell or barbell handle. In some embodiments, U-channel 506 allows for positioning a center of gravity and/or weight distribution of a dumbbell or barbell between a lifter's hands and/or at a midpoint of an axis defined by the lifter's two hands.

For example, a lifter may use attachment to lift, using two/both hands, a dumbbell or barbell positioned within U-channel 506 using first bar 501 and second bar 502. In this example, when the lifter lifts the dumbbell or barbell, the center of gravity and/or weight distribution of the dumbbell or barbell will be between his hands and/or at the midpoint of an axis defined by his two hands when gripping first bar 501 and second bar 502.

In another example, a lifter may use attachment to lift, using two/both hands, a dumbbell or barbell positioned within U-channel 506 using third bar 503 and fourth bar 504. In this example, when the lifter lifts the dumbbell or barbell, the center of gravity and/or weight distribution of the dumbbell or barbell will be between his hands and/or at the midpoint of an axis defined by his two hands when gripping third bar 503 and fourth bar 504.

In some embodiments, one or more of each notch and tooth mechanism may engage one or more releasable locking mechanisms 509*a* and 509*b*. One or more of each releasable locking mechanisms 509*a* and 509*b* may comprise, for example, a spring-loaded and/or rotatable about a screw attachment to central housing 505 lever, clip, handle, and/or switch. Releasable locking mechanisms 509*a* and 509*b* may, for example, engage with notch and tooth mechanisms on upper 507*b*, lower 507*c*, respectively, to clamp lid 507*a* in a closed position around, for example, a handle and/or grip of a dumbbell or barbell.

In some embodiments, housing and/or central housing 505 may comprise one or more end plates 505*a*-505*b*. In some embodiments, end plates 505*a*-505*b* may be rectangular and/or comprise rounded sides and/or ends. Rounded sides may allow for safety advantages in some cases.

In some embodiments, one or more bars may be installed and/or attached to housing or central housing wherein the one or more bars are installed symmetrically to each other. In one example, first bar 501 may be installed and/or attached to central housing end plates 505*a*-505*b* symmetrically to second bar 502.

In some embodiments, each of end plates 505*a*-505*b* may comprise a shape and/or cutout comprising a U-shaped channel ("U-channel") allowing intake of a dumbbell or barbell (such as a dumbbell handle).

Rounded end plates may be attached to, or by, one or more bars. For example, as shown in 500, first bar 501 and second bar 502 may each be attached to each end plate, creating a contiguous and/or reinforced structure.

In some embodiments, end plates may comprise holes through which one or more bars are fitted. In some examples, bars may be set within holes and protrude from holes by, for example, between 0.15 inches and 0.5 inches on each side of end plate attachment. Each protrusion may allow for welding, riveting and/or fixing bars within their respective holes to provide a structurally sound device, such as by a welding technique, riveting technique, or riveting-like technique, as described previously.

In one example, end plates 505*a*-505*b* may comprise holes or openings through which first bar 501 and second bar 502 are fitted. For example, first bar 501 may be fitted through first hole 511*a*. And, for example, second bar 502 may be fitted through second hole 511*b*.

As described previously, a riveting technique, or riveting-like technique may be used to install and/or attached one or more bars to end plates.

In one example, first bar 501 may be comprised of a factory head and tail used as a shop head, as described. First bar 501 may be passed through a hole 511*a* and fixed or installed to end plate 505*a* using a riveting and/or riveting-like technique. Alternatively, and/or in combination, a welding technique may be used to fix and/or install first bar 501 within or to end plate 505*a*.

In another example, second bar 502 may be comprised of a factory head and tail used as a shop head, as described. Second bar 502 may be passed through a hole 511*b* and fixed or installed to end plate 505*a* using a riveting and/or riveting-like technique. Alternatively, and/or in combination, a welding technique may be used to fix and/or install second bar 502 within or to end plate 505*a*.

It will be understood that first bar 501 and second bar 502, for example, may be similarly fixed and/or attached to second end plate 505*b*.

It will also be understood that third bar 503 and fourth bar 504, for example, may be similarly fixed and/or attached to first end plate 505*a* and second end plate 505*b*.

Similarly, support or support member 505*c* may be riveted through one or more end plates such as end plate 505*a*.

In some embodiments, central housing 505 may further comprise one or more safety mechanisms, such as a safety strap 510. Safety strap 510 may comprise a nylon and/or Velcro safety strap that can wrap around the center binding mechanism and/or clamp lid 507*a* when in a closed position, as shown in 500, for example.

Advantages

The embodiments described herein provide numerous advantages over existing technology.

In one example, the embodiments described herein bind to a wide variety of dumbbells or barbells on the market, allowing a range of interoperability and adaptability. The range of exercises that may be enabled by use of the embodiments described herein is greatly increased with minimal additional equipment without buying expensive bars and weights and/or storing additional equipment.

Many different embodiments have been disclosed herein, in connection with the above description and the drawings. It will be understood that it would be unduly repetitious and obfuscating to literally describe and illustrate every combination and subcombination of these embodiments. Accordingly, all embodiments can be combined in any way and/or combination, and the present specification, including the drawings, shall be construed to constitute a complete written description of all combinations and subcombinations of the embodiments described herein, and of the manner and process of making and using them, and shall support claims to any such combination or subcombination.

It will be appreciated by persons skilled in the art that the present embodiment is not limited to what has been particularly shown and described hereinabove. A variety of modifications and variations are possible in light of the above teachings without departing from the following claims.

What is claimed is:

1. A dumbbell or barbell attachment device to enable two-handed exercises, comprising:

a first bar comprising a first grip area, wherein the first bar is comprised of cast iron, steel, aluminum, brass, ceramic, carbon fiber, or plastic;

a second bar comprising a second grip area, wherein the second bar is comprised of cast iron, steel, aluminum, brass, ceramic, carbon fiber, or plastic;

a third bar comprising a third grip area, wherein the second bar is comprised of cast iron, steel, aluminum, brass, ceramic, carbon fiber, or plastic; and a fourth bar comprising a fourth grip area, wherein the second bar is comprised of cast iron, steel, aluminum, brass, ceramic, carbon fiber, or plastic, wherein the first bar, the second bar, the third bar, and the fourth bar are attached to a central housing, and wherein the central housing is comprised of cast iron, steel, aluminum, brass, ceramic, carbon fiber, or plastic;

wherein the first bar and the second bar are of equal size and equal shape, wherein the first bar and the second bar are cylindrical, and wherein the first bar and second bar are arranged in a configuration parallel to each other;

wherein the third bar and the fourth bar are each in a curl bar shape or configuration; and wherein the central housing comprises: a first U-channel, the first U-channel comprising a first support member sized and shaped to accommodate a weightlifting bar having a first diameter within a first range of diameters; and a first clamp lid comprising an upper notch and tooth mechanism and a lower notch and tooth mechanism.

2. The device of claim 1, wherein the central housing further comprises:

a first releasable locking mechanism to engage the upper notch and tooth mechanism, wherein the first releasable locking mechanism comprises a first locking attachment to the central housing rotatable about a first screw or pivot element, and wherein the first locking attachment comprises a first lever, clip, handle, or switch.

3. The device of claim 2, wherein the central housing further comprises:

a second releasable locking mechanism to engage the lower notch and tooth mechanism, wherein the second releasable locking mechanism comprises a second locking attachment to the central housing, rotatable about a second screw or pivot element, and wherein the second locking attachment comprises a second lever, clip, handle, or switch.

4. The device of claim 3, wherein one or more sides or edges of the first U-channel are padded, and wherein the dumbbell or barbell attachment device can be releasably attached to weightlifting bars of varying diameters.

5. The device of claim 4, wherein the first grip area and the second grip area are configured to allow a user to simultaneously take a first grip of both the first grip area and the second grip area to manipulate a first attached dumbbell or barbell.

6. The device of claim 5, wherein the third grip area and the fourth grip area are configured to allow a user to simultaneously take a second grip of both the third grip area and the fourth grip area to manipulate the first attached dumbbell or barbell.

7. A dumbbell or barbell attachment device to enable two-handed exercises, comprising:

a first bar comprising a first grip area, wherein the first bar is comprised of cast iron, steel, aluminum, brass, ceramic, carbon fiber, or plastic;

a second bar comprising a second grip area, wherein the second bar is comprised of cast iron, steel, aluminum, brass, ceramic, carbon fiber, or plastic, wherein the first bar and the second bar are each riveted to a central housing comprising a first end plate and second end plate, and wherein the central housing is comprised of cast iron, steel, aluminum, brass, ceramic, carbon fiber, or plastic;

wherein the first bar and the second bar are of equal size and equal shape, wherein the first bar and the second bar are cylindrical, and wherein the first bar and second bar are arranged in a configuration parallel to each other;

wherein the third bar and the fourth bar are each in a curl bar shape or configuration; and wherein the central housing comprises: a first U-channel, the first U-Channel comprising a first support member sized and shaped to accommodate a weightlifting bar having a first diameter within a first range of diameters; and a first clamp lid comprising an upper notch and tooth mechanism and a lower notch and tooth mechanism.

8. The device of claim 7, wherein the central housing further comprises:

a first releasable locking mechanism to engage the upper notch and tooth mechanism, wherein the first releasable locking mechanism comprises a first locking attachment to the central housing rotatable about a first screw or pivot element, and wherein the first locking attachment comprises a first lever, clip, handle, or switch.

9. The device of claim 8, wherein the central housing further comprises:

a second releasable locking mechanism to engage the lower notch and tooth mechanism, wherein the second releasable locking mechanism comprises a second locking attachment to the central housing, rotatable about a second screw or pivot element, and wherein the second locking attachment comprises a second lever, clip, handle, or switch.

10. The device of claim 9, wherein one or more sides or edges of the first U-channel are padded.

11. The device of claim 10, wherein the dumbbell or barbell attachment device can be releasably attached to weightlifting bars of varying diameters.

12. A dumbbell or barbell attachment device to enable two-handed exercises, comprising:

a first bar comprising a first grip area;

a second bar comprising a second grip area, wherein the first bar and the second bar are each riveted to a first end plate and a second end plate, wherein the first grip area and the second grip area allow a user to simultaneously take a first grip of both the first grip area and the second grip area to manipulate a first attached dumbbell or barbell, and wherein a center of gravity of the first attached dumbbell or barbell is at a midpoint defined by an axis;

wherein the first bar and the second bar are of equal size and equal shape, wherein the first bar and the second bar are cylindrical, and wherein the first bar and second bar are arranged in a configuration parallel to each other;

wherein the third bar and the fourth bar are each in a curl bar shape or configuration; and wherein the central housing comprises: a first U-channel, the first U-Channel comprising a first support member sized and shaped to accommodate a weightlifting bar having a first diameter within a first range of diameters; and a first clamp lid comprising an upper notch and tooth mechanism and a lower notch and tooth mechanism.

* * * * *